US010905237B1

(12) United States Patent
Millerbernd

(10) Patent No.: US 10,905,237 B1
(45) Date of Patent: Feb. 2, 2021

(54) ROLLER CHAIR

(71) Applicant: Ralph Millerbernd, Winsted, MN (US)

(72) Inventor: Ralph Millerbernd, Winsted, MN (US)

( * ) Notice: Subject to any disclaimer, the term of this patent is extended or adjusted under 35 U.S.C. 154(b) by 0 days.

(21) Appl. No.: 16/946,503

(22) Filed: Jun. 24, 2020

(51) Int. Cl.
*A47B 83/02* (2006.01)
*A47C 3/18* (2006.01)
*A47C 7/00* (2006.01)

(52) U.S. Cl.
CPC ..... *A47B 83/02* (2013.01); *A47C 3/18* (2013.01); *A47C 7/004* (2013.01)

(58) Field of Classification Search
CPC ..... A47B 83/02; A47B 83/0215; A47C 3/18; A47C 7/004
See application file for complete search history.

(56) References Cited

U.S. PATENT DOCUMENTS 363,226 A 5/1887 Gowell
553,108 A * 1/1896 Davison ..... A47B 83/02 297/142
2,824,598 A 2/1958 Ertl
3,951,449 A 4/1976 Crowther
4,736,998 A * 4/1988 Wilson ..... B25H 1/04 312/235.3
5,385,154 A 1/1995 Fuhrman et al.
5,647,636 A 7/1997 Allen
5,875,779 A * 3/1999 Fuhrman ..... A47C 15/008 128/845
6,102,475 A 8/2000 Hamann
6,209,952 B1 * 4/2001 Huang ..... A47B 83/02 297/157.1
6,227,614 B1 * 5/2001 Rubin ..... A47C 9/022 297/143
7,448,097 B2 11/2008 Cancian
10,123,622 B1 11/2018 Hall
2007/0046078 A1 3/2007 Humfeldt et al.

* cited by examiner

*Primary Examiner* — Philip F Gabler
(74) *Attorney, Agent, or Firm* — Kinney & Lange, P.A.

(57) ABSTRACT

A chair includes a fixture housing configured for mounting to a floor. A first roller is connected to the fixture housing and a second roller is connected to the fixture housing. A bar extends into the fixture housing between the first roller and the second roller. A post extends from the bar and a seat is connected to the post.

19 Claims, 6 Drawing Sheets

ROLLER CHAIR

BACKGROUND

The present disclosure relates to furniture, and particularly to chairs and stools.

In most dining settings, chairs (including stools) are provided separate from a table or a bar cabinet. In these instances, the chairs rest on the floor and, in some instances, can scratch or damage the floor when the chairs slide on the floor. Attempts have been made to avoid this problem by integrating the chairs with tables or cabinets so that the chairs do not contact the floor. However, these chairs often have a restricted range of motion that makes the chairs difficult to mount and difficult to exit. Chairs that are integrated with tables or cabinets also generally cannot handle the same weight as traditional chairs without significant and costly reinforcement to the table or cabinet to which the chair is connected.

SUMMARY

In one aspect of the disclosure, a chair includes a fixture housing configured for mounting to a floor. A first roller is connected to the fixture housing and a second roller is connected to the fixture housing. A bar extends into the fixture housing between the first roller and the second roller. A post extends from the bar and a seat is connected to the post.

In another aspect of the disclosure, a chair includes a post extending from a first end to a second end. A seat is connected to the first end of the post. The chair also includes a fixture housing, a first roller assembly connected to the fixture housing, and a second roller assembly connected to the fixture housing. A bar extends from a first end to a second end. The second end of the post is connected to the bar proximate the first end of the bar, and the bar extends into the fixture housing between the first roller assembly and the second roller assembly.

In yet another aspect of the disclosure, a chair includes a post extending from a first end to a second end and a seat connected to the first end of the post. The chair includes a base with a fixture housing, a first roller connected to the fixture housing, and a second roller connected to the fixture housing. The base also includes a bar extending from a first end to a second end. The second end of the post is connected to the bar proximate the first end of the bar. The bar extends into the fixture housing between the first roller and the second roller.

Persons of ordinary skill in the art will recognize that other aspects and embodiments of the present invention are possible in view of the entirety of the present disclosure, including the accompanying figures.

Figure 1:
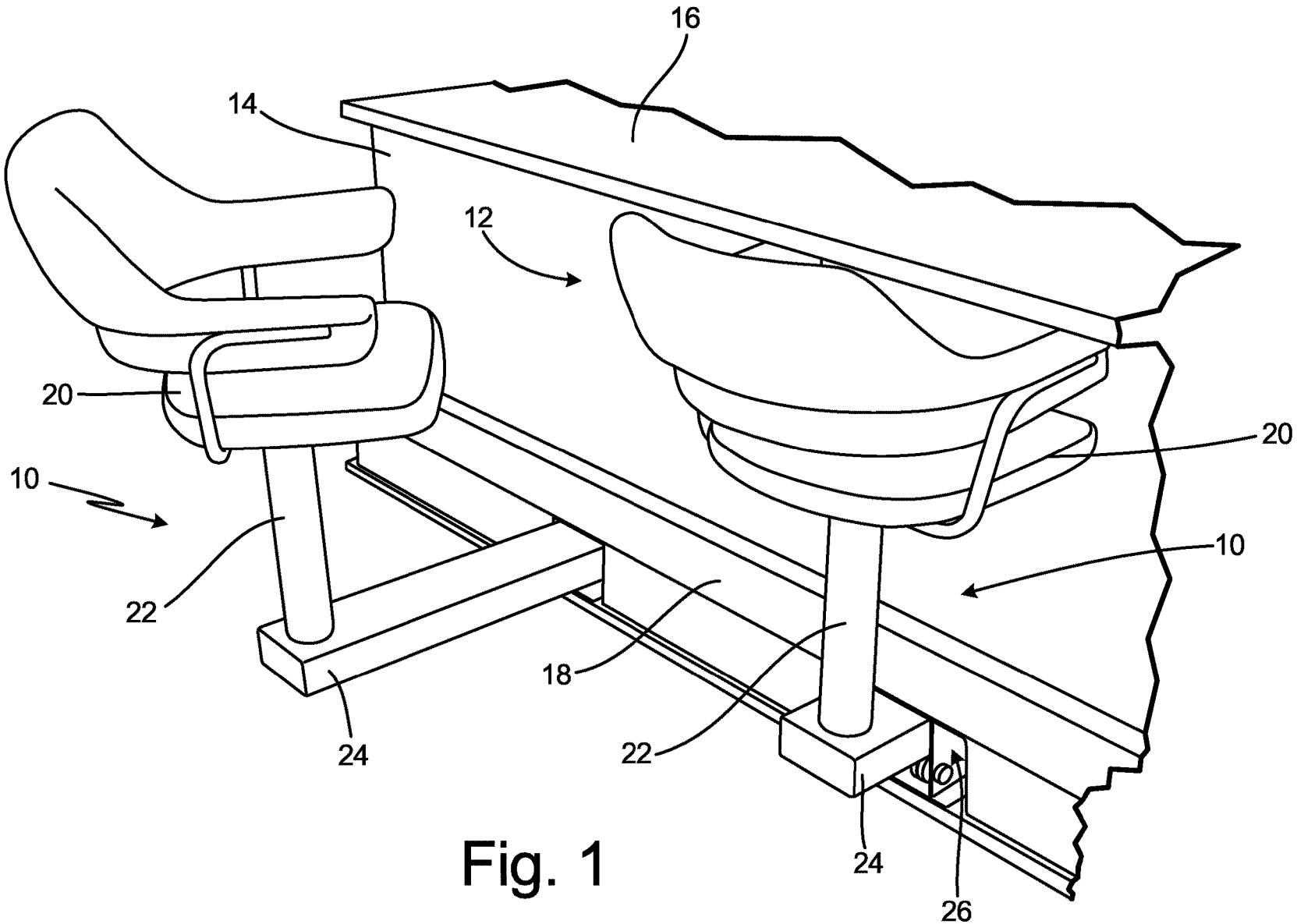
FIG. 1 is a perspective view of a pair of chairs and a bar cabinet.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

FIG. 1 is a perspective view of a pair of chairs 10 and bar cabinet 12. As shown in FIG. 1, bar cabinet 12 includes cabinet box 14, bar top 16, and foot bench 18. Each of chairs 10 includes seat 20, post 22, bar 24, and fixture 26. A cover is removed in FIG. 1 to expose fixture 26 of one of chairs 10. Bar cabinet 12 can be a commercial bar cabinet, such as in a restaurant. Bar cabinet 12 can also be a residential bar cabinet, such as those commonly found in home kitchens and dining spaces. Cabinet box 14 supports bar top 16. Foot bench 18 can be formed from cabinet box 14 or can be a separate unite connected to a base of cabinet box 14. Fixture 26 and bar 24 together form a base of chair 10. Fixture 26 of chair 10 is concealed by cabinet box 14 and mounted to the floor underneath bar cabinet 12. Bar 24 extends through foot bench 18 and into fixture 26 and can slide relative fixture 26 in a direction parallel to a length of bar 24. Seat 20 is connected to bar 24 by post 22. Seat 20 can rotate relative post 22. In the embodiment of FIG. 1, seat 20 has a back rest and arm rests. In other embodiments, seat 20 can have a back rest but no arm rests. In further embodiments, seat 20 can be a stool seat without a back rest and without arm rests. When an individual desires to sit in one of chairs 20, the individual can pull on seat 20, causing bar 24 to slide relative fixture 26, which in turn causes seat 20 to move away from bar cabinet 12. After mounting seat 20, the individual can pull on bar top 16 to cause bar 24 to slide and retract into foot bench 18, thereby easily and smoothly moving seat 20 closer to bar cabinet 12.

Figure 2:
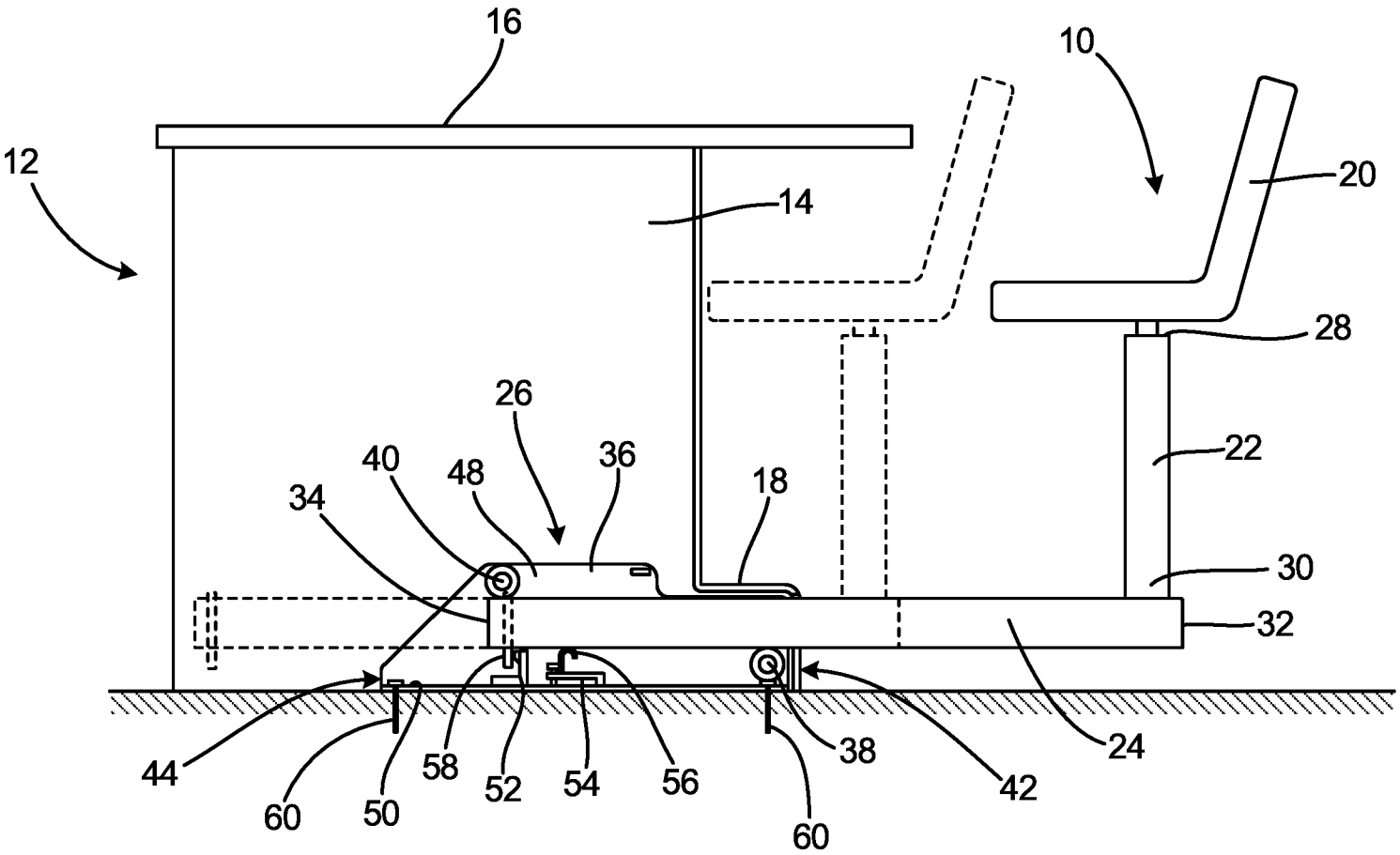
FIG. 2 is a cross-sectional view of a chair and a bar cabinet.
Figure 3:
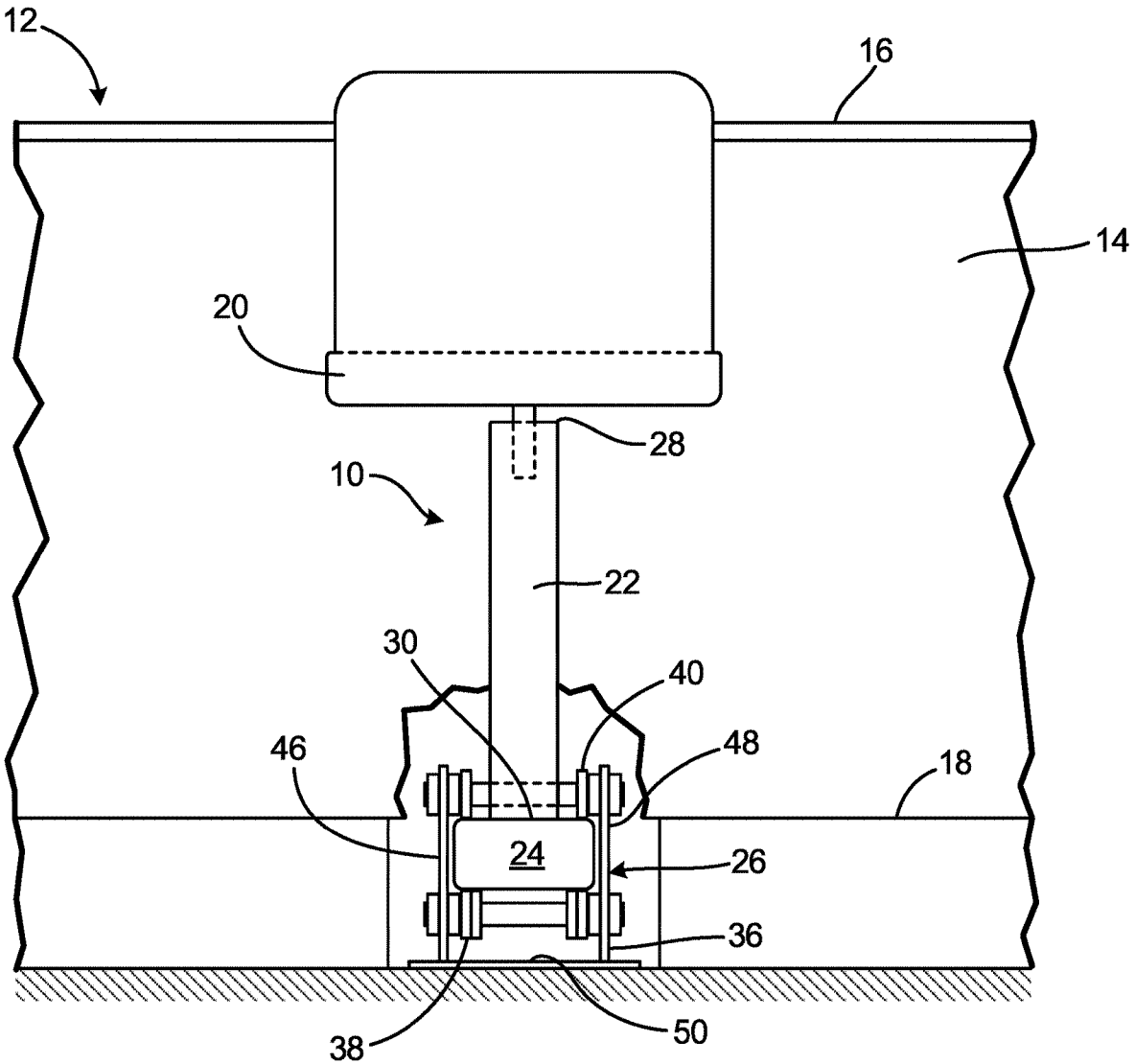
FIG. 3 is a rear elevation view of the chair and the bar cabinet from FIG. 2.

FIGS. 2 and 3 will be discussed concurrently. FIG. 2 is a cross-sectional view of bar cabinet 12 and one of chairs 10. FIG. 3 is a rear elevation view of chair 10 and bar cabinet 12. As shown in FIGS. 2 and 3, post 22 includes first end 28 and second end 30. Bar 24 includes first end 32 and second end 34. Fixture 26 includes housing 36, first roller assembly 38, and second roller assembly 40. Housing 36 includes front end 42, back end 44, first side plate 46, second side plate 48, and bottom plate 50. Fixture 26 also includes stop bumper 52 and guide 54 with pad 56 or roller 56. Bar 24 also includes stop pin 58. Fasteners 60 connect fixture 26 to a floor underneath bar cabinet 12. Together, bar 24 and fixture 26 form a base for chair 10.

First side plate 46, second side plate 48, and bottom plate 50 together form housing 36 of fixture 26. First side plate 46 extends in the lengthwise direction from front end 42 of housing 36 to back end 44 of housing 36. Second side plate 48 is spaced from first side plate 46 and also extends in the lengthwise direction from front end 42 of housing 36 to back end 44 of housing 36. Bottom plate 50 extends underneath first side plate 46 and second side plate 48 and is connected to both first side plate 46 and second side plate 48. Front end 42 and back end 44 are both open so as to accommodate bar 24. First side plate 46, second side plate 48, and bottom plate 50 are formed from sheet steel, such as 3/16-inch steel.

First roller assembly 38 is connected to housing 36 and extends between first side plate 46 and second side plate 48 near front end 42. First roller assembly 38 is positioned low in housing 36 so that first roller assembly 38 is below bar 24 when chair 10 is assembled. Second roller assembly 40 is also connected to housing 36 and extends between first side plate 46 and second side plate 48. Second roller assembly 40 is positioned high in housing 36 so that second roller assembly 40 is above bar 24 when chair 10 is assembled. Second roller assembly 40 is positioned rearward from first roller assembly 38 in the lengthwise direction.

Bar 24 extends from first end 32 to second end 34 in a lengthwise direction. Second end 30 of post 22 is connected to bar 24 proximate first end 32 of bar 24. Bar 24 extends into housing 36 of fixture 26 through front end 42 between first side plate 46 and second side plate 48. Bar 24 extends between first roller assembly 38 and second roller assembly 40. Post 22 extends from first end 28 to second end 30. Second end 30 of post 22 is connected to first end 32 of bar 24 and seat 20 is connected to first end 28 of post 22. Seat 20 can be pivotally connected to post 22 so that seat 20 can be rotated relative post 22. Seat 20 can be a simple pad with no back, a seat with a back, a seat with arm rests, or any other seat that can be mounted to post 22. When a person sits in seat 20, the weight-force of the person is transferred from seat 20 to bar 24 through post 22. The weight-force is then transferred to housing 36 of fixture 26 via first roller assembly 38 and second roller assembly 40. From housing 36 the weight-force is transferred to the floor via fasteners 60.

During the assembling process of chair 10, second end 34 of bar 24 is inserted into the open front end 42 of housing 36. Back end 44 of housing is also open to allow bar 24 to extend through housing 36 when seat 20 is moved toward bar cabinet 12 (shown in phantom in FIG. 2). An opening can be provided in foot bench 18 to allow bar 24 access to fixture 26. As bar 24 extends through housing 36 of fixture 26, bar 24 is supported by first roller assembly 38 and second roller assembly 40. Stop pin 58 is inserted into a hole in second end 34 of bar 24 and extends through and below and outward from bar 24. Stop pin 58 is configured to engage stop bumper 52 to prevent second end 34 of bar 24 from being accidentally pulled out of fixture 26 when bar 24 is fully extended. Stop bumper 52 is mounted to bottom plate 50 of housing 36. Post 22 is connected to first end 32 of bar 24 and seat 20 is connected to post 22. Housing 36 of fixture 26 is connected to the floor under the cabinet via fasteners 60. Fasteners 60 can be screws, bolts, or any other fastener suitable for mounting fixture 26 to the floor. In some embodiments, housing 36 can be connected to the bottom of the cabinet box 14 if cabinet box 14 is sturdy enough to withstand the relatively high forces that will act on chair 10 when a person sits in seat 20 and extends bar 24.

Figure 4:
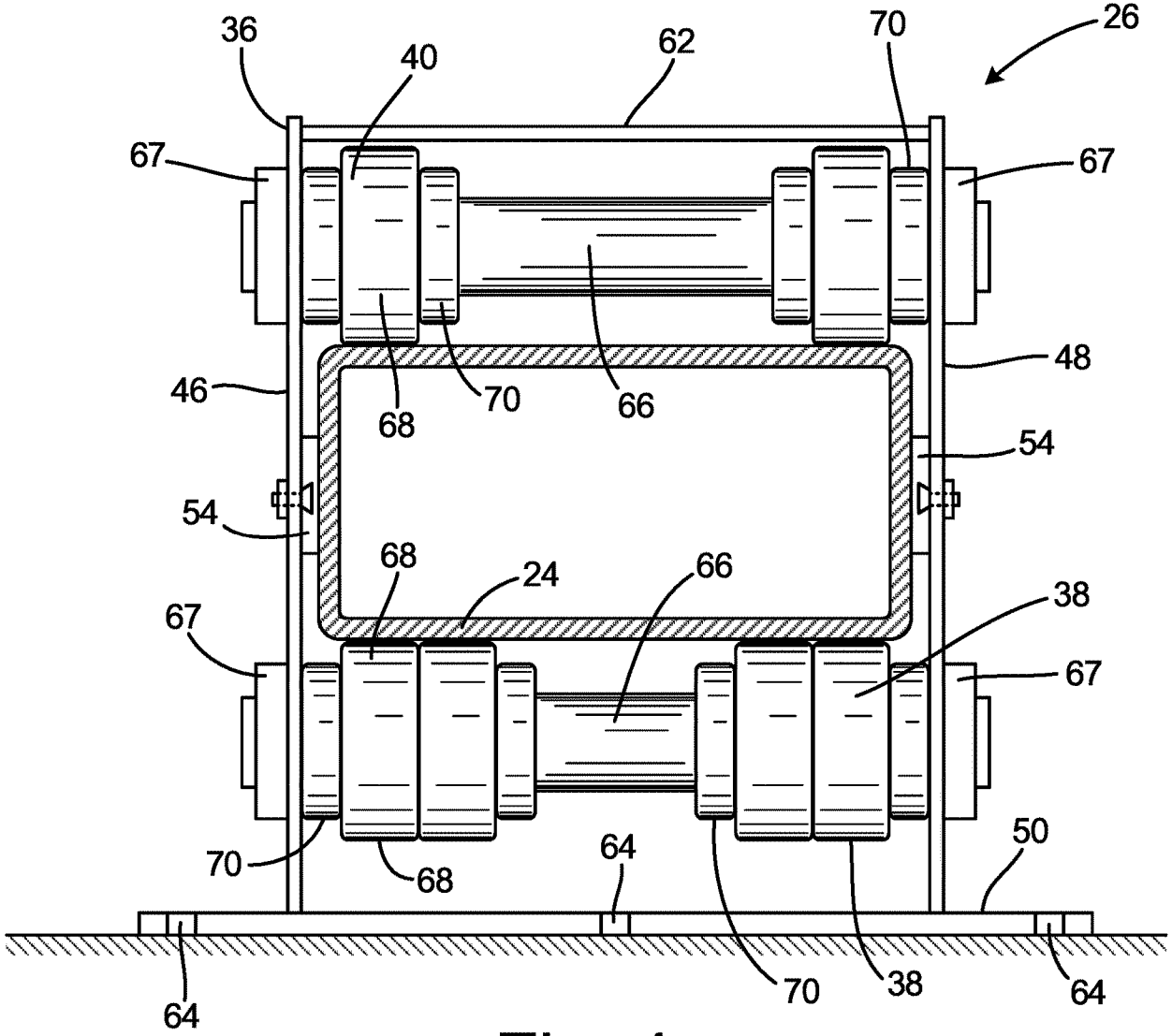
FIG. 4 is a cross-sectional view of a base fixture for the chair from FIG. 2.

Guide 54 is mounted inside of housing 36 of fixture 26 between bar 24 and housing 36. Guide 54 includes resistance pads 56, such as felt pads, that contact bar 24 and reduce side-to-side motion and rocking motion of bar 24. In other embodiments, guide 54 includes a stabilizer roller 56 that contacts bar 24 and reduces side-to-side motion and rocking motion of bar 24. FIG. 2 shows guide 54 connected to bottom plate 50 of housing 36 under bar 24. As shown in FIG. 4, additional guides 54 can be connected to first side plate 46 and second side plate 48 to further stabilize bar 24.

FIG. 4 is a cross-sectional view of bar 24 and fixture 26 for chair 10. Additional guides 54 are connected to first side plate 46 and second side plate 48 and contact bar 24. Guides 54 prevent side-to-side motion of bar 24 and also provide a desirable level of resistance between bar 24 and housing 26 to slow the motion of bar 24 and seat 20. Slowing the motion of bar 24 reduces the likelihood of seat 20 slamming against bar cabinet 12 when seat 20 is pushed toward bar cabinet 12. Sliding bar 24 can be formed from hollow tubular steel to resist bending. In the embodiment shown in FIG. 4, sliding bar 24 is formed from stainless steel tubing with a rectangular cross-sectional profile that is three inches by six inches.

First roller assembly 38 and second roller assembly 40 each includes at least one roller 68 on a rod 66, the rod 66 being connected to first side plate 46 and second side plate 48 of housing 36. Each of rods 66 can be a one-inch diameter threaded steel rod fastened to housing 36 by nuts 67 that are threaded onto rods 66 and locked into place by adhesive or mechanical means. Spacers 70 are provided on rods 66 to position rollers 68 and prevent rollers 68 from rubbing against housing 36. Spacers 70 can be nuts threaded onto rods 66. In the embodiment of FIG. 4, first roller assembly 38 includes four rollers 68 and second roller assembly 40 includes two rollers 68. Each roller 68 can include sealed ball bearings (not shown) to reduce friction between rollers 68 and rods 66.

Housing 36 also includes top plate 62. Top plate 62 forms a top of housing 36 and extends from first side plate 46 to second side plate 48. Top plate 62 can be shorter than bottom plate 50 in the lengthwise direction so as to allow access to the interior of housing 36 through the top of housing 36. Bottom plate 50 is wider than the distance between first side plate 46 and second side plate 48 so as to form base flanges outside of housing 36. Holes 64 are provided in bottom plate 50 to accommodate fasteners 60 (shown in FIG. 2).

Figure 5:
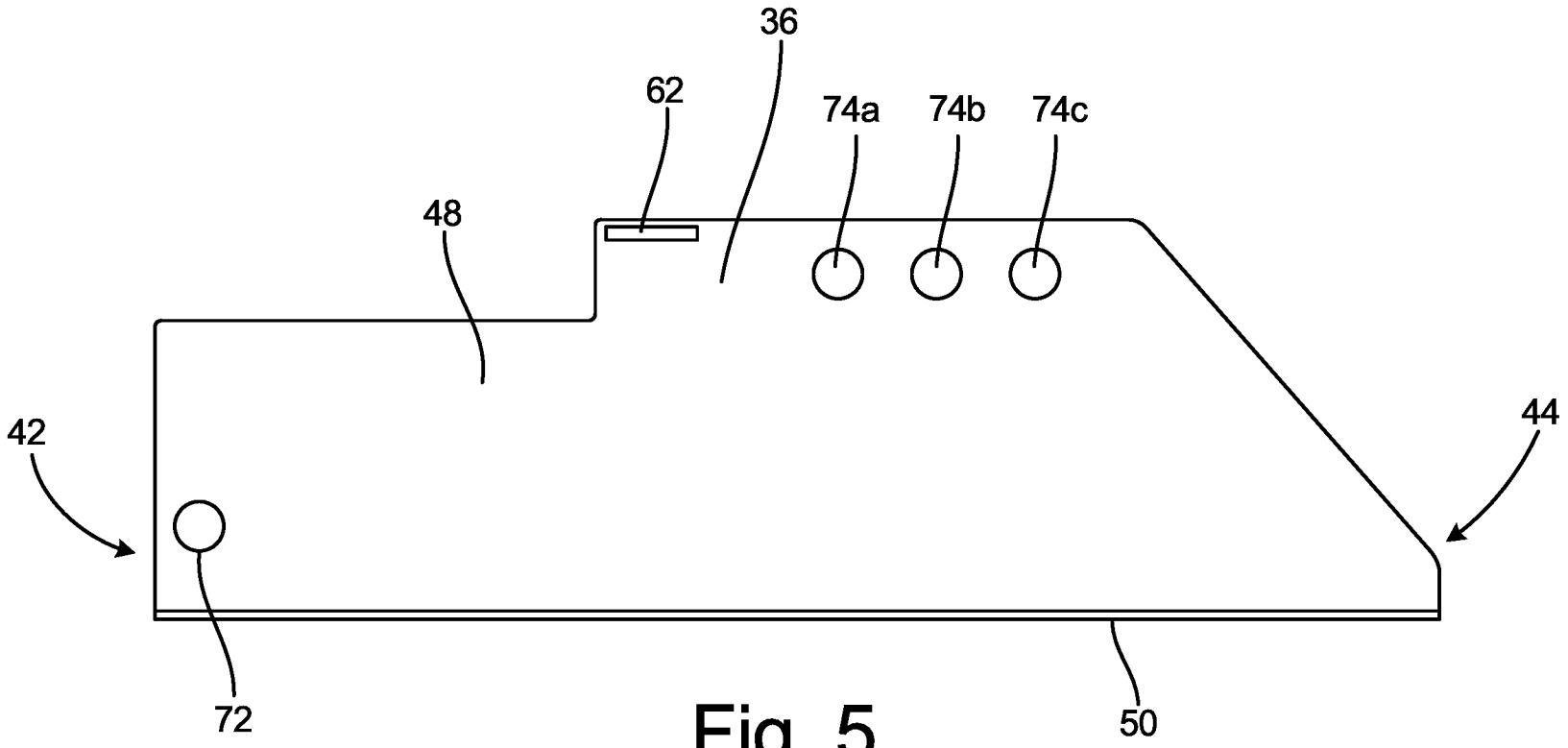
FIG. 5 is a side elevation view of a housing for the base fixture for the chair from FIG. 4.

FIG. 5 is a side elevation view of another embodiment of housing 36 for fixture 26. As shown in FIG. 5, each of side plates 46, 48 (only side plate 48 is shown in FIG. 5) includes hole 72 formed near front end 42 to accommodate rod 66 of first roller assembly 38. Holes 74*a*, 74*b*, 74*c* are also formed in side plates 46, 48 to receive rod 66 of second roller assembly 40. Holes 74*a*, 74*b*, 74*c* allow the position second roller assembly 40 to be adjusted in the lengthwise direction. Hole 74*c* is closer to back end 44 of housing 36 than hole 74*a* and hole 74*b*. Hole 74*a* is closer to front end 42 of housing 36 than hole 74*b* and hole 74*c*. Hole 74*b* is between hole 74*a* and hole 74*c*. When second roller assembly 40 is positioned at hole 74*c* a longer bar 24 can be used in chair 10. When second roller assembly 40 is positioned at hole 74*a* a shorter and lighter bar 24 can be used in chair 10.

Figure 6:
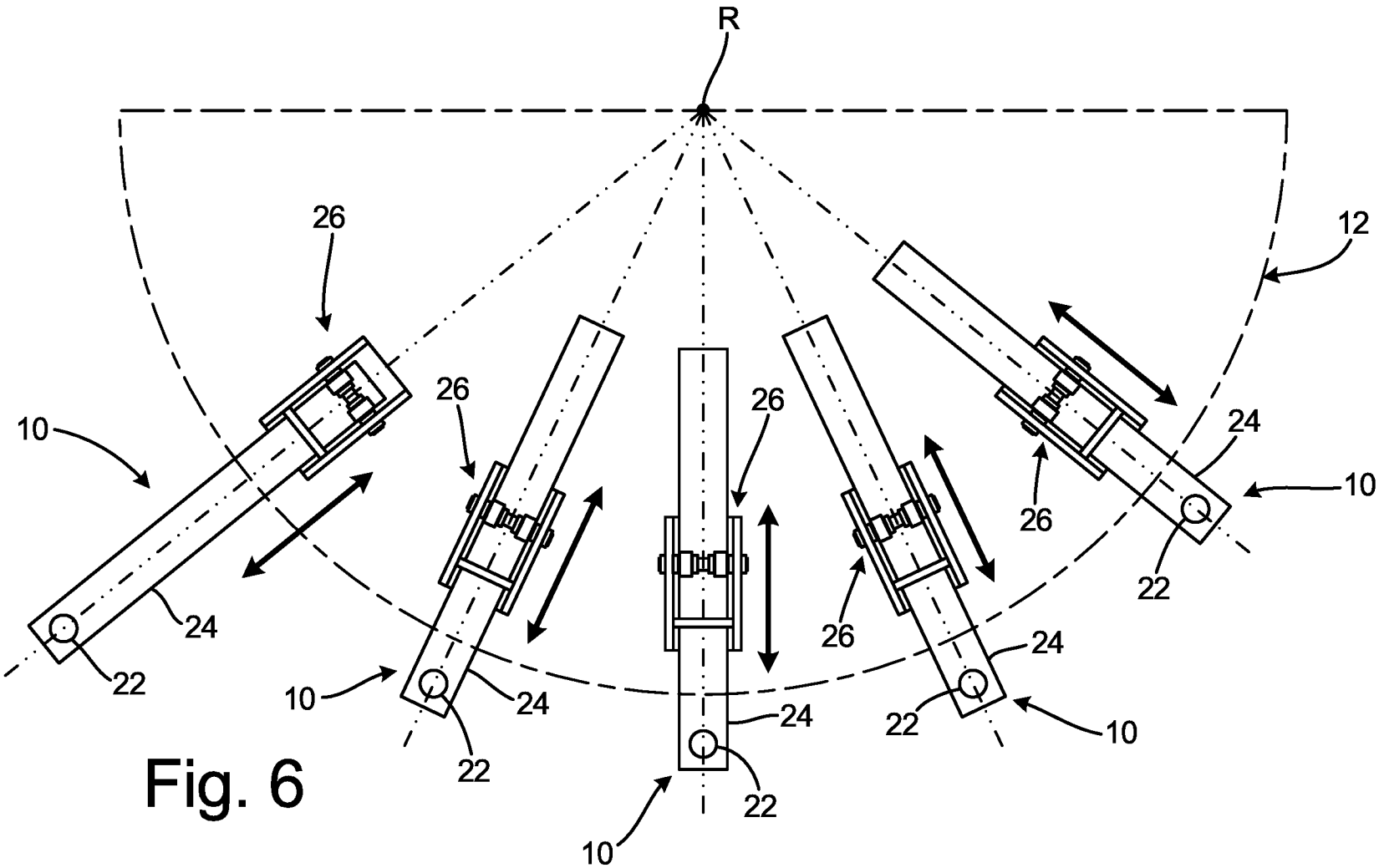
FIG. 6 is a schematic diagram of a round cabinet with a plurality of chairs.

FIG. 6 is a schematic diagram of round bar cabinet 12 with a plurality of chairs 10. As shown in FIG. 6, chairs 10 are spaced circumferentially on round bar cabinet 12 from each other and arranged about radial center point R of round bar cabinet 12. As shown in FIG. 6, chair 10 can be used with any table, bar cabinet, or desk that has sufficient space to cover or house fixture 26 and bar 24 when bar 24 is fully retracted under the table, bar cabinet, or desk.

Overall, chair 10 provides a retractable seat that is both sturdy and attractive. Sliding bar 24 is low and close to the floor without contacting the floor. Because bar 24 does not contact the floor, bar 24 does not damage the floor as seat 20 is pulled out and pushed toward bar cabinet 12. With bar 24 low to the floor, a user can seat themselves in seat 20 without bar 24 interfering with their legs or without having to raise their legs very high off the floor. The construction of chair 10 is sturdy and strong and transfers all the weight of the user to the floor.

While the invention has been described with reference to an exemplary embodiment(s), it will be understood by those skilled in the art that various changes may be made and equivalents may be substituted for elements thereof without departing from the scope of the invention. For example, a wheel can be added beneath first end 32 of bar 24 to provide additional strength and stability to chair 10. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A chair comprising:

a fixture housing configured for mounting to a floor;

a first roller connected to the fixture housing;

a second roller connected to the fixture housing;

a bar extending into the fixture housing between the first roller and the second roller;

a post extending from the bar; and a seat connected to the post, wherein the first roller is below the bar, and wherein the second roller is above the bar.

2. The chair of claim 1, wherein the fixture housing comprises:

a first side plate;

a second side plate spaced from the first side plate; and a bottom plate under the first side plate and the second side plate, wherein the first roller extends between the first side plate and the second side plate, and wherein the second roller extends between the first side plate and the second side plate.

3. The chair of claim 2, wherein the first roller is positioned relative a length direction of the bar between the post and the second roller.

4. The chair of claim 1, wherein the bar is a hollow tube with a rectangular cross-sectional profile.

5. The chair of claim 1, further comprising:

a guide connected to the fixture housing and extending between the fixture housing and the bar, wherein the guide comprises:

a pad contacting the bar.

6. The chair of claim 1, further comprising:

a bumper connected to the fixture housing; and a stop pin connected to the bar and extending outward from the bar;

wherein the stop pin is configured to contact the bumper and prevent removal of the bar from the fixture housing.

7. A chair comprising:

a post extending from a first end to a second end;

a seat connected to the first end of the post;

a fixture housing;

a first roller assembly connected to the fixture housing;

a second roller assembly connected to the fixture housing; and a bar extending from a first end of the bar to a second end of the bar, wherein the second end of the post is connected to the bar proximate the first end of the bar, and wherein the bar extends into the fixture housing between the first roller assembly and the second roller assembly, wherein the first roller is below the bar, and wherein the second roller is above the bar.

8. The chair of claim 7, wherein the fixture housing comprises:

a first side plate extending in a lengthwise direction from a front end of the fixture housing to a back end of the fixture housing;

a second side plate spaced from the first side plate and extending in the lengthwise direction from the front end of the fixture housing to the back end of the fixture housing; and a bottom plate between the first side plate and the second side plate, wherein the first roller assembly extends between the first side plate and the second side plate, and wherein the second roller assembly extends between the first side plate and the second side plate.

9. The chair of claim 8, wherein the bar extends into the fixture housing through the front end of the fixture housing, the bar is between the first side plate and the second side plate, and the first roller assembly is positioned forward of the second roller assembly in the lengthwise direction.

10. The chair of claim 9, wherein the bar is a hollow tube with a rectangular cross-sectional profile.

11. The chair of claim 9, further comprising:

a guide connected to the fixture housing and extending between the fixture housing and the bar, wherein the guide comprises:

a pad contacting the bar.

12. The chair of claim 11, further comprising:

a bumper connected to the fixture housing; and a stop pin extending outward from the bar proximate the second end of the bar;

wherein the stop pin is configured to contact the bumper and prevent removal of the bar from the fixture housing.

13. The chair of claim 9, wherein the back end of the fixture housing is open and sized to allow the bar to extend through the back end.

14. The chair of claim 8, wherein the first roller assembly comprises a first plurality of rollers on a first rod, wherein the first rod extends from the first side plate to the second side plate, and the second roller assembly comprises a second plurality of rollers on a second rod, wherein the second rod extends from the first side plate to the second side plate.

15. The chair of claim 14, wherein the first plurality of rollers comprises more rollers than the second plurality of rollers.

16. A chair comprising:

a post extending from a first end to a second end;

a seat connected to the first end of the post;

a base, wherein the base comprises:

a fixture housing;

a first roller connected to the fixture housing;

a second roller connected to the fixture housing; and a bar extending from a first end of the bar to a second end of the bar, wherein the second end of the post is connected to the bar proximate the first end of the bar, and wherein the bar extends into the fixture housing between the first roller and the second roller, wherein the first roller is below the bar, and wherein the second roller is above the bar.

17. The chair of claim 16, wherein the fixture housing comprises:

a first side wall extending in a lengthwise direction from a front end of the fixture housing to a back end of the fixture housing;

a second side wall spaced from the first side wall and extending in the lengthwise direction from the front end of the fixture housing to the back end of the fixture housing; and a bottom wall between the first side wall and the second side wall, wherein the first roller extends between the first side wall and the second side wall, and wherein the second roller extends between the first side wall and the second side wall.

18. The chair of claim 17, wherein the bar extends into the fixture housing through the front end of the fixture housing, the bar is between the first side wall and the second side wall, and the first roller is positioned forward of the second roller in the lengthwise direction.

19. The chair of claim 18, wherein the back end of the fixture housing is open and sized to allow the bar to extend through the back end.

* * * * *